US011655095B1

(12) United States Patent
Lettieri

(10) Patent No.: US 11,655,095 B1
(45) Date of Patent: May 23, 2023

(54) ADDITIVE APPLICATOR SYSTEM AND METHOD OF USE

(71) Applicant: Paul Lettieri, Dallas, TX (US)

(72) Inventor: Paul Lettieri, Dallas, TX (US)

( * ) Notice: Subject to any disclaimer, the term of this patent is extended or adjusted under 35 U.S.C. 154(b) by 0 days.

(21) Appl. No.: 17/318,756

(22) Filed: May 12, 2021

Related U.S. Application Data

(60) Provisional application No. 63/023,801, filed on May 12, 2020.

(51) Int. Cl.
*B65D 51/28* (2006.01)
*B65D 81/32* (2006.01)

(52) U.S. Cl.
CPC ..... *B65D 81/32* (2013.01)

(58) Field of Classification Search
CPC ..... B65D 81/32; B65D 21/0233; B65D 51/2807; B65D 51/28; B65D 81/3205
USPC ..... 203/219; 206/219; 220/23.83, 521, 906; 215/227
See application file for complete search history.

(56) References Cited

U.S. PATENT DOCUMENTS 2,863,778 A * 12/1958 Lynn ..... B65D 25/20 426/120
3,796,813 A * 3/1974 Kurland ..... B65D 51/28 206/568
4,917,258 A * 4/1990 Boyd ..... B65D 21/0222 220/240
5,290,574 A * 3/1994 Jamieson ..... B65D 85/73 426/123
7,163,129 B1 * 1/2007 Bennett ..... B65D 81/3216 221/199
7,967,135 B2 * 6/2011 Boatner ..... B65D 17/401 426/115
8,365,960 B1 * 2/2013 Kalaouze ..... B65D 81/3211 206/229
8,579,129 B2 * 11/2013 Gruenwald ..... B65D 23/12 215/6
8,875,926 B2 * 11/2014 Grajqevci ..... B65D 17/4014 222/557
9,731,879 B2 * 8/2017 Sheldon ..... B65D 51/28
2005/0098561 A1 * 5/2005 Schwoebel ..... B65D 17/4012 220/258.1

* cited by examiner

*Primary Examiner* — Steven A. Reynolds
(74) *Attorney, Agent, or Firm* — J. Miguel Hernandez; James R. Gourley; Carstens, Allen & Gourley, LLP

(57) ABSTRACT

An additive applicator system allows for a substance such as salt, flavor enhancement or similar things. The additive is placed in a carrier that is shaped to sit in the top ring of a common aluminum can. The carrier has an opening or spout that allows for the additive to be transferred to the interior of the can.

9 Claims, 3 Drawing Sheets

ADDITIVE APPLICATOR SYSTEM AND METHOD OF USE

BACKGROUND

1. Field of the Invention

The present invention relates generally to beverage systems, and more specifically, to an additive applicator system for transporting and then facilitating the mixture of a substance in a beverage.

2. Description of Related Art

Beverage systems are well known in the art and are effective means to produce, transport, sell and enjoy fluids for consumption. Commonly, beverages are prepared and then placed on containers such as bottles and cans for storage and later consumption. For example, aluminum cans are used to hold beverages as they are light easy to carry and moderately resilient.

One of the problems commonly associated with common beverage systems is its limited use. For example, metallic cans are not conducive to carry beverages that have corrosive properties such as resulting from high salt content. So, while cans are capable of carrying alcohol, carbonated beverages they are limited in what they can hold. While liners and other coatings have been developed, they do not solve in an efficient manner the need to store, hold and carry corrosive beverages.

Accordingly, although great strides have been made in the area of beverage systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
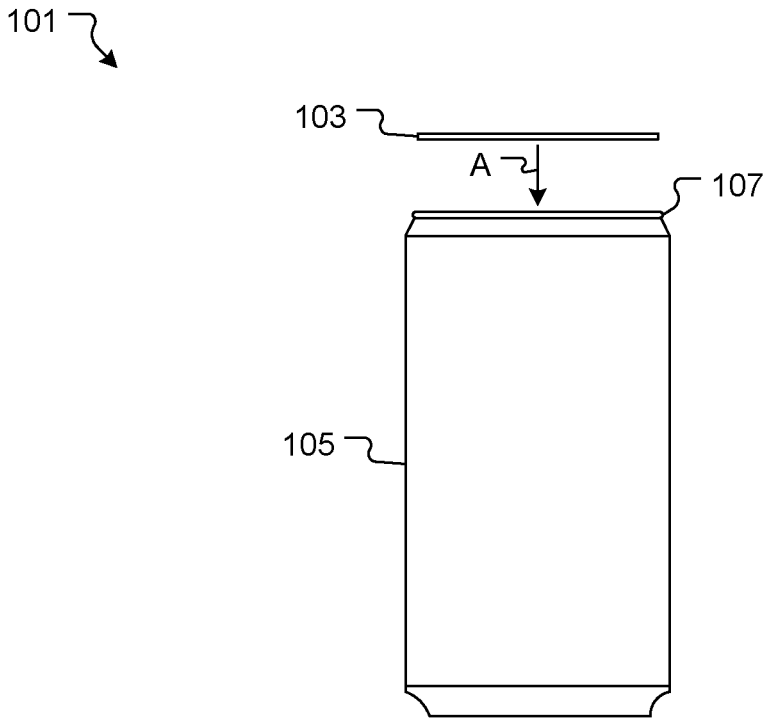
FIG. 1 is a front view of an additive applicator system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional beverage systems. Specifically, the present invention provides means of carrying an additive with a beverage that after mixing would not safely carry in a can. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a side view of an additive applicator system in accordance with a preferred embodiment of the present application. It will be appreciated that system 101 overcomes one or more of the above-listed problems commonly associated with conventional beverage systems.

Figure 2:
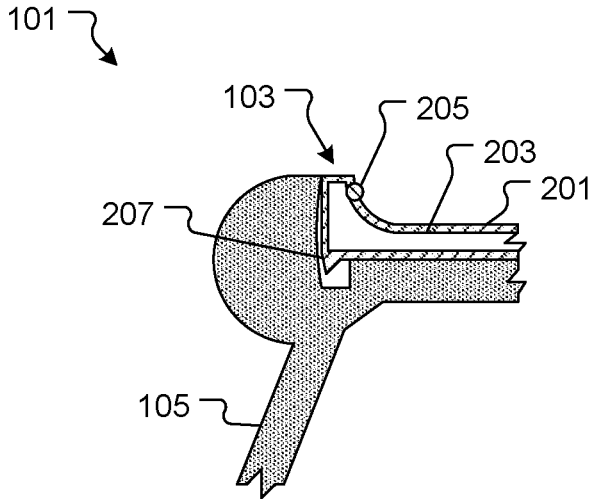
FIG. 2 is a cross-sectional side view of the carrier of FIG. 1.

In the contemplated embodiment, system 101 includes a carrier 103 configured to attach to a ring 107 of a can 105, as depicted by motion A, so that it rests therein as depicted by FIG. 2. The carrier 103 includes a body 201 that encloses a space 203 therein. The space 203 is configured to hold an additive substance and is accessible via an opening 205. The body 201 also includes a retainer 207 configured to hold the body 201 against the top of the can 105.

It is contemplated that the body 201 is configured to not interfere with the normal function of the can such as stacking, opening or drinking. It is further contemplated that the carrier 103 could be transported or dispensed separately from the can 105 and that they are only joined at the point of use.

The additive substance could be anything to be added to the can 105 with or without a beverage.

In use, an additive substance, such as salt is stored in space 203 and the carrier 103 is attached to the top of can 105 with a beverage therein. When consumption is desired, the opening 205 is accessed and the additive transferred to the open can, mixed therein and the beverage with the additive is consumed.

It should be appreciated that one of the unique features believed characteristic of the present application is that carrier 103 allows for the separate storage and transportation of an additive and beverage without inconvenience.

Figure 3:
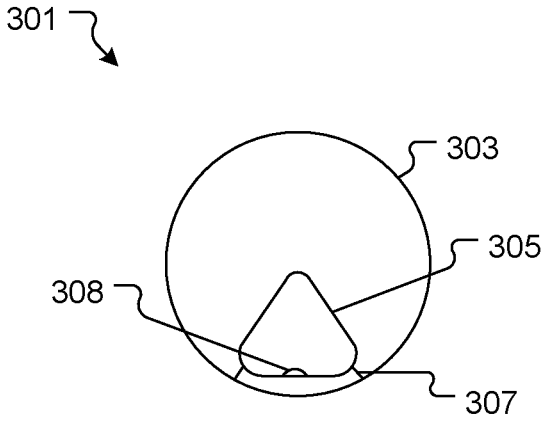
FIG. 3 is a top view of an alternative embodiment of the carrier of FIG. 1.

Referring now to FIG. 3 an alternative embodiment of the carrier 103 is depicted. Embodiment 301 includes similar features as carrier 103 wherein the body includes a passageway 305 in the body 303 that is configured to sit over the orifice of the can 105 to access to the beverage. The opening 307 is depicted to cover the portion of the passageway 305 between the orifice and the edge of the can 105 and accessible by a pull tab 308. It will be understood and appreciated that any means of access to and from the space 203 is contemplated. These embodiments are provided as examples.

Figure 4:
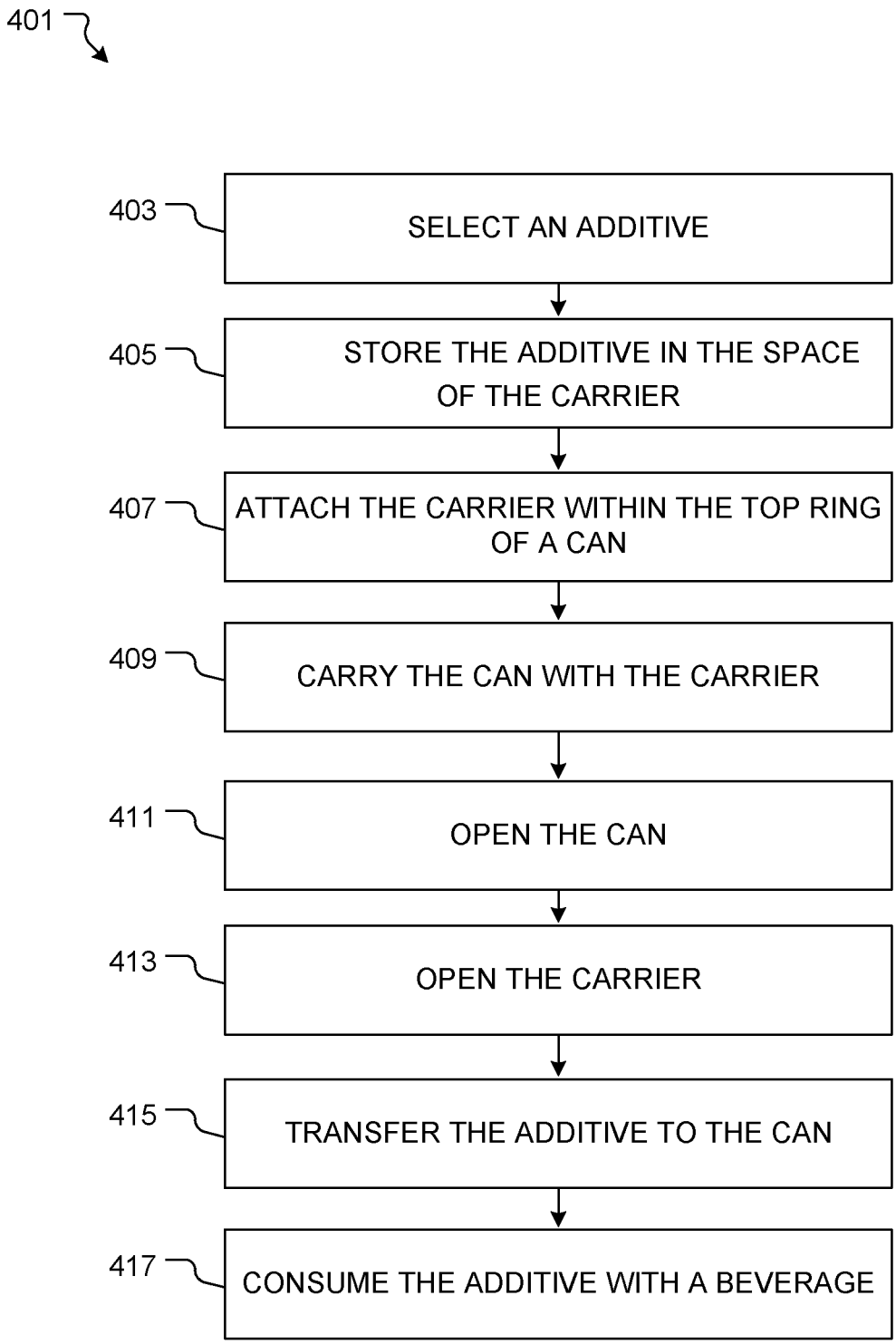
FIG. 4 is a flow chart of a method of consuming an additive with a beverage.

Referring now to FIG. 4 a method of including a supplemental material in a portable beverage. Method 401 includes selecting an additive 403, storing the additive in the space of the carrier 405, attaching the carrier within the top ring of a can 407, carrying the can with the carrier 409, opening the can 411, opening the carrier 413, transferring the additive to the can 415 and consuming the additive with a beverage 417.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An additive applicator system, comprising:

a can; and an additive carrier comprising:

a body;

the body having a circular outer periphery;

the body having a space within the body, the space accessible through an opening and configured to carry a substance;

the body comprising a retainer configured to hold the body at a position outside the can and within a lip of a ring at a top of the can;

wherein the additive carrier configured to be attached to the ring at the top of the can;

wherein the additive carrier holding an additive that can be combined with contents of the can;

wherein the additive carrier is configured to attach to the can within the ring at the top of the can without extending above the ring.

2. The additive applicator system of claim 1, the circular outer periphery contacting an inner surface of the ring at the top of the can.

3. The additive applicator system of claim 2, the circular outer periphery configured to contact the inner surface of the ring at the top of the can and thereby attach the additive carrier to the can.

4. The additive applicator system of claim 1, the additive carrier having a concavity in a top surface of the additive carrier.

5. The additive applicator system of claim 4, the concavity configured to receive a bottom of the can or the bottom of another can with the same shape as the can.

6. The additive applicator system of claim 5, the can being a first can;

the system comprising a second can;

the concavity configured to receive a bottom of the second can having a shape identical to the first can, and the additive carrier configured to enable stacking the second can on top of the first can by inserting a bottom of the second can into the concavity while the additive carrier is attached to the top of the first can.

7. The additive applicator system of claim 4, additive carrier comprising a protrusion at a bottom of the additive carrier, the protrusion having an inner surface that slopes downwardly and outwardly.

8. The additive applicator system of claim 7, the can comprising a depression along the inner surface of the ring at the top of the can, the protrusion of the additive carrier configured, by engaging the depression along the inner surface of the ring at the top of the can, to guide the additive carrier into a position for attachment to the can.

9. A method of including a supplemental material in a portable beverage using the additive carrier of claim 1, the method comprising:

selecting an additive;

storing the additive in the space of the additive carrier;

attaching the additive carrier within a top ring of a can comprising the portable beverage;

carrying the can with the additive carrier;

opening the can;

opening the additive carrier;

transferring the additive to the can; and consuming the additive with the portable beverage.

* * * * *